US005798620A

United States Patent [19]

Wacyk et al.

[11] Patent Number: 5,798,620

[45] Date of Patent: Aug. 25, 1998

[54] FLUORESCENT LAMP DIMMING

[75] Inventors: Ihor T. Wacyk, Briarcliff Manor; Vinit Jayaraj, Ossining, both of N.Y.; Eugen J. De Mol, Eindhoven, Netherlands

[73] Assignee: Philips Electronics North America Corporation, New York, N.Y.

[21] Appl. No.: 768,346

[22] Filed: Dec. 17, 1996

[51] Int. Cl.[6] ..... G05F 1/00

[52] U.S. Cl. ..... 315/307; 315/291; 315/224; 315/209 R; 315/DIG. 4

[58] Field of Search ..... 315/291, DIG. 4, 315/297, 307, 360, 362, 224, 208, 209 R; 323/237, 325; 307/139, 141

[56] References Cited

U.S. PATENT DOCUMENTS

| | | | |
|---|---|---|---|
| 4,680,508 | 7/1987 | Rucki | 315/166 |
| 4,695,739 | 9/1987 | Pierce | 307/141 |
| 4,802,073 | 1/1989 | Plumly | 362/251 |
| 4,952,849 | 8/1990 | Fellows et al. | 315/307 |
| 5,030,890 | 7/1991 | Johnson | 315/208 |
| 5,055,746 | 10/1991 | Hu et al. | 315/291 |
| 5,107,184 | 4/1992 | Hu et al. | 315/291 |
| 5,146,139 | 9/1992 | Nilssen | 315/205 |
| 5,225,741 | 7/1993 | Auld, Jr. et al. | 315/307 |
| 5,504,398 | 4/1996 | Rothenbuhler | 315/209 R |

FOREIGN PATENT DOCUMENTS

| | | |
|---|---|---|
| 0053896A1 | 6/1982 | European Pat. Off. . |
| 2151115 | 7/1985 | United Kingdom . |

*Primary Examiner*—Robert J. Pascal
*Assistant Examiner*—Haissa Philogene
*Attorney, Agent, or Firm*—Edward Blocker

[57] ABSTRACT

Step dimming of a fluorescent lamp load through sensing of power line interruptions generated through the toggling of a switch. The number of power line interruptions through toggling produced within a predetermined period of time identifies the level of dimming desired. In the event that interruption of power to the ballast exceeds the predetermined period of time, the lamp load will be reset to a prefixed level of illumination once power is restored.

23 Claims, 5 Drawing Sheets

FLUORESCENT LAMP DIMMING

BACKGROUND OF THE INVENTION

This invention relates generally to a dimming scheme for one or more fluorescent lamps and, more particularly, to a dimming scheme for one or more fluorescent lamps in which the level of illumination is controlled through toggling of a switch.

Fluorescent lamp controllers (i.e. ballasts), such as disclosed in U.S. Pat. No. 4,952,849 and sold by Advance Transformer Company of Rosemont, Ill. under the MARK V trademark of Philips Electronics North America Corporation of New York, N.Y., operate in pre-ignition and ignition phases to obtain stable operation and reliable control of a DC-AC converter. The converter is supplied with a DC voltage from a preconditioner having a switched-mode power supply. An output circuit, coupling the converter to a fluorescent lamp load, supplies a high frequency, substantially sinusoidal signal to the fluorescent lamp load for igniting and powering the latter. The controller monitors signals from the output circuit and preconditioner for controlling starting and efficient lamp operation. The controller, however, has no dimming capability.

Conventional light dimming schemes which control the level of illumination by toggling a switch are generally associated with incandescent lighting. A dimming scheme, such as disclosed in European Patent Application No. 0053896, includes an adaptor which is placed in the electrical path between the mains power supply and the incandescent light bulb. The adaptor fits into the light socket with the light bulb being screwed into the adaptor and includes a triac for cutting off a portion of the mains voltage cycle applied to the incandescent light bulb. The average power supplied to the incandescent bulb is reduced by applying less than the full mains voltage cycle to the incandescent bulb. A reduction in the level of light produced by the bulb results. The adaptor is responsive to one or more interruptions of the mains supply within a predetermined period of time in controlling the portion of the mains voltage cycle to be applied to the lamp.

The incandescent light dimming scheme, as disclosed in European Patent Application No. 0053896, is not suitable for fluorescent lamp dimming. A triac when placed between the mains power supply and the fluorescent lamp ballast can be made to operate so as to reduce the instantaneous voltage supplied to the fluorescent lamp by applying less than the full mains voltage cycle to the fluorescent lamp ballast (i.e. cutting the full mains voltage cycle). The ballast, however, causes the peak instantaneous current to rise in response to a reduction in the full mains voltage cycle. A relatively constant rather than reduced average lamp current results. Ballast components also may be subjected to undesirable peak current stresses and resulting voltage spikes when less than the full mains voltage cycle is applied to the ballast.

It is therefore desirable to provide an improved lamp ballast controller having dimming capability. The light dimming scheme should be responsive to an interruption in the mains power supply through the toggling of a switch in controlling the level of illumination desired.

SUMMARY OF THE INVENTION

Generally speaking, in accordance with a first aspect of the invention, a ballast switchably coupled to a voltage source for powering a lamp includes an inverter, sense circuitry and an oscillator. The inverter is responsive to a driving signal having a varying frequency. The sense circuitry senses each interruption in the coupling between the ballast and voltage source. The oscillator generates the driving signal at a frequency which varies based on the number of sensed interruptions in coupling between the ballast and voltage source.

By varying the frequency of the driving signal based on the number of sensed interruptions in coupling between the ballast and voltage source, the ballast provides a dimming scheme which is extremely simple to operate. Through the mere toggling of a switch, such as a wall switch, which couples the voltage source to the ballast, a fluorescent lamp can be set to a plurality of different levels of illumination.

The ballast features a temporary voltage source to power the sense circuitry for a predetermined period of time beginning with the first interruption. The ballast also features reset circuitry for changing the frequency of the driving signal generated by the oscillator to a prefixed level in response to an interruption extending beyond the predetermined period of time. A counter within the sense circuitry identifies the number of sensed interruptions within the predetermined period of time. It is yet another feature of the invention to include a current source for each non-zero value of the counter, each current source producing a different level of current. The oscillator changes the frequency of the driving signal based on the level of current produced by the current source corresponding to the non-zero value of the counter.

In accordance with a second aspect of the invention, a compact fluorescent lamp includes a ballast switchably coupled to a voltage source for powering a lamp. The ballast includes an inverter, sense circuitry and an oscillator. The inverter is responsive to a driving signal having a varying frequency. The sense circuitry senses each interruption in the coupling between the ballast and voltage source. The oscillator generates the driving signal at a frequency which varies based on the number of sensed interruptions in coupling between the ballast and voltage source. It is a feature of this second aspect of the invention that the ballast of the compact fluorescent lamp be switchably coupled to the voltage source through a three way switch.

In accordance with a third aspect of the invention, a method for adjusting the level of illumination of a fluorescent lamp powered by a ballast switchably coupled to a voltage source includes the steps of interrupting the coupling between the ballast and voltage source at least once within a predetermined period of time, sensing each interruption in coupling between the ballast and voltage source and applying a voltage to the fluorescent lamp at a frequency which varies in response to the number of sensed interruptions in coupling between the ballast and voltage source. It is a feature of this third aspect of the invention that the method further include temporarily providing power to sense circuitry for sensing each interruption for a predetermined period of time beginning with the first interruption.

Accordingly, it is an object of the invention to provide an improved fluorescent lamp ballast having illumination control based on the toggling of a switch.

It is another object of the invention to provide an improved fluorescent lamp ballast having dimming control based on the toggling of a switch within a predetermined period of time.

It is yet another object of the invention to provide an improved fluorescent lamp ballast which resets the lamp load to a prefixed level of illumination following restoration of power when preceded by an interruption of power to the ballast exceeding a predetermined period of time.

These and other objects and advantages of the invention will, in part, be obvious and will, in part, be apparent from the specification.

The invention accordingly comprises several steps and the relation of one or more such steps with respect to each of the others, and the device embodying features of construction, combinations of elements and arrangements of parts which are adapted to effect such steps, all is exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
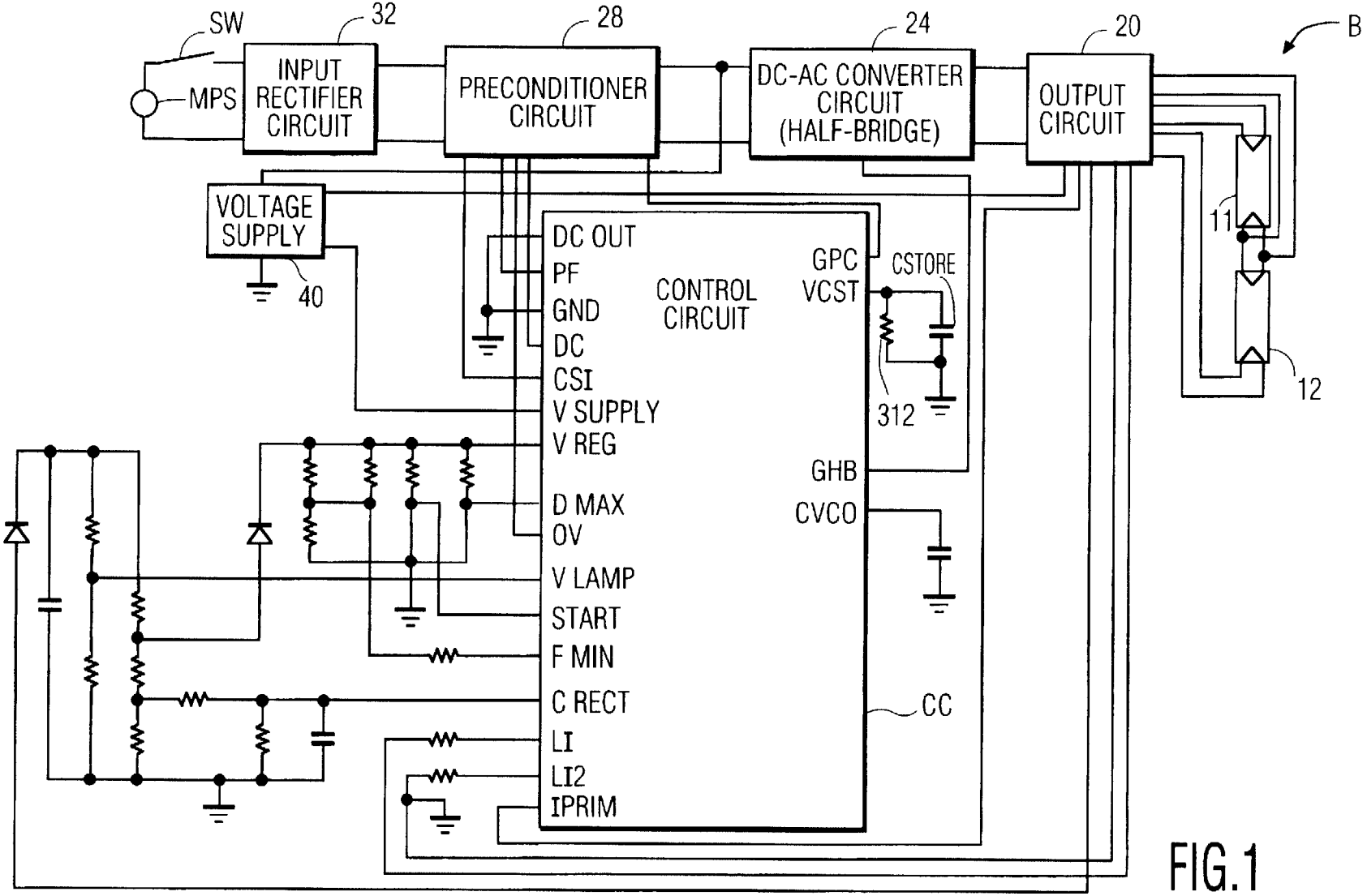
FIG. 1 is a partial block and partial schematic diagram illustrating a ballast in accordance with a first embodiment of the invention.

As shown in FIG. 1, in accordance with a first embodiment of the invention, a ballast B for powering one or more fluorescent lamps is connected between a mains power supply MPS and a pair of fluorescent lamps 11 and 12. Mains power supply MPS is a voltage source at 50 or 60 hertz, 120 volt RMS voltage. Ballast B includes an output circuit 20, a DC-AC converter (also known as a DC-AC inverter) circuit 24, a preconditioner 28, an input rectifier circuit 32, a control circuit CC and a voltage supply 40.

A switch SW such as, but not limited to, a wall switch supplies and interrupts the supply of power to ballast B (i.e. couples and interrupts the coupling between mains power supply MPS and ballast B). Input rectifier circuit 32 includes a filter and a full bridge rectifier. The filter prevents high frequency components produced by ballast B being introduced into mains power supply MPS. The full bridge rectifier rectifies the AC signal provided by mains power supply MPS. Preconditioner 28 responds to a full-wave rectified 50 or 60 hertz (Hz) voltage having a peak value of about 170 volts, produced by input rectifier circuit 32, and supplies a DC voltage having an average magnitude of about 245 volts to DC-AC converter circuit 24. The DC voltage from preconditioner circuit 28 is changed by DC-AC converter circuit 24 to a square wave AC voltage which is applied to output circuit 20 and which has a frequency range of from about 25 to 50 kHz. It is to be understood that values of voltages and frequencies described herein as well as values of other variables and components disclosed hereinafter are provided for illustrative purposes only to facilitate understanding of the invention and are not to be construed as limitations therein.

Both preconditioner circuit 28 and DC-AC converter circuit 24 include SMPS (switch mode power supply) circuitry and are controlled by a control circuit CC which responds to various signals developed by output circuit 20 and preconditioner circuit 28. Preconditioner circuit 28 is a variable duty cycle up-converter and is supplied with a pulse-width modulated gating signal from a pin GPC of control circuit CC. DC-AC converter circuit 24 is a half-bridge converter circuit and is supplied with a square wave gating signal from a pin GHB of control circuit CC.

Control circuit CC is an integrated circuit and includes logic and analog circuitry responsive to various signals from preconditioner circuit 28 and output circuit 20 to develop the pulse-width modulated and square wave gating signals. Upon initial energization of ballast B and during its steady state operation, an operating voltage is supplied to control circuit CC through voltage, supply 40.

Ballast B, except as otherwise noted herein, is similar in construction and operation to the ballast identified as a fluorescent lamp controller 10 of U.S. Pat. No. 4,952,849. Like reference letters and numerals identify components of similar construction and operation within ballast B and fluorescent lamp controller 10 of U.S. Pat. No. 4,952,849. A more detailed description of the construction and operation of output circuit 20, DC-AC converter circuit 24, preconditioner 28, input rectifier circuit 32 and voltage supply 40 is set forth in U.S. Pat. No. 4,952,849. The construction and operation of output circuit 20, DC-AC converter circuit 24, preconditioner 28, input rectifier circuit 32 and voltage supply 40 as disclosed in U.S. Pat. No. 4,952,849 is incorporated herein by reference thereto.

Control circuit CC is a 20 pin integrated circuit for controlling voltage regulation, low supply lock-out protection, lamp voltage regulation, low half-bridge voltage lock-out, overvoltage protection, half-bridge oscillation, pulse width modulation, output buffers, capacitive load protection, biasing, over-current protection, power factor amplification, DC error amplification and lamp current rectification. A brief functional description regarding these 20 pins now follows. A more complete description can be had by reference to a control circuit 36 of U.S. Pat. No. 4,952,849.

A regulated voltage is provided at a VREG pin of control circuit CC. The regulated voltage serves as a reference voltage as well as the power supply for the control logic within control circuit CC. The DC power supply voltage provided by voltage supply 40 is sensed at a VSUPPLY pin of control circuit CC and is used to determine when preconditioner circuit 28 and DC-AC converter circuit 24 should turn on or off. Once the power supply voltage rises above an upper trip point, preconditioner circuit 28 and DC-AC converter 24 become operational. When DC-AC converter circuit 24 is turned off, it is not allowed to turn back on until the supply voltage at pin VSUPPLY exceeds the upper trip point and a minimum time delay has passed as set by external components at a DMAX pin of control circuit CC.

Control circuit CC senses when the lamp voltage as represented by the voltage at a VLAMP pin exceeds a reference voltage. Under such conditions, the lamp voltage has reached its maximum allowed open circuit value and control circuit CC increases the frequency of the square wave driving signal produced at pin GHB so as to increase the switching frequency of DC-AC converter circuit 24. A reduction in lamp voltage results. The rapidity in the increase of switching frequency is set by an external resistor and capacitor connected to a START pin of control circuit CC.

The lamp ignition sequence of the half-bridge oscillator of DC-AC converter circuit 24 is inhibited until the preconditioner output voltage has reached a prefixed value as set by external components. The preconditioner output voltage is sensed by an overvoltage input pin OV of control circuit CC. When this input exceeds a prefixed portion of the voltage at the VREG pin, the switching frequency of DC-AC converter 24 sweeps downwardly which begins the lamp ignition sequence.

When the voltage at the OV pin is greater than the voltage at the VREG pin, control circuit CC prevents any further increase in the preconditioner DC output voltage. An overvoltage or overshoot generated by the preconditioner can occur during turn on when the SMPS is not loaded and the circuit is underdamped. Control circuit CC produces a triangular wave at a CVCO pin. The frequency of the square wave driving signal at the GHB pin depends, in part, on the level of current fed into an FMIN pin and the value of an external capacitor connected to the CVCO pin.

In control circuit 36 of U.S. Pat. No. 4,952,849 a ramp voltage (sawtooth waveform) at a CP pin has the same frequency and slope and is in synchronization with the triangular waveform produced at the CVCO pin. The ramp voltage is produced through the combination of a current source and charging capacitor, the latter of which is externally connected to the CP pin. In accordance with the invention, this ramp signal is produced (synthesized) within control circuit CC by using the triangular signal at the CVCO pin. The charging capacitor connected to the CP pin in U.S. Pat. No. 4,952,849 is eliminated. A pin of control circuit 36 is thus made free and is used by control circuit CC as a VCST pin. External components (i.e. a capacitor CSTORE and a resistor 312) connected to the VCST pin fix the predetermined period of time during which switch SW must be toggled at least once so as to adjust the level of illumination produced by the lamp load.

Control circuit CC also prevents failure of the half bridge power transistors during lamp removal by limiting the switching frequencies of DC-AC converter circuit 24 to above the resonant frequency of an external LC network driven by the bridge. At frequencies above resonance, the primary voltage of the half-bridge LC load network leads the primary current in phase. At frequencies below resonance, the primary current leads the primary voltage in phase. A pair of power transistors within DC-AC converter 24 at frequencies below resonance will be driven to conduct at a time when each of their drain currents has a high transient peak. Both resonant and below resonant operation can lead to switch failure due to high peak currents and high transient power dissipation. Protection logic within control circuit CC senses the LC network current phase relative to the half-bridge gate drive voltage to determine if a resonant condition exists. An IPRIM input voltage represents the primary current signal from the external LC network. When the voltage at IPRIM is more positive than a prefixed level and the gate drive signal is high, the switching frequency of the DC-AC converter is rapidly increased to avoid operating the DC-AC converter circuit below resonance.

An overcurrent condition is typically produced during turn on of the SMPS or when the AC line voltage, that is, the mains power supply MPS, has a power interruption. The overcurrent is sensed by an external resistor connected to a current sense input pin CSI. The phase and amplitude of a peak rectified AC line voltage is sensed to modulate the duty cycle of a power switch in preconditioner circuit 28 so as to improve the sinusoidal wave shape of the AC line current. The power factor input is sensed at a PF input pin of control circuit CC.

A DC pin senses the DC output voltage through an external resistor voltage divider and filter network. Control circuit CC includes a DC error amplifier connected to the DC pin so as to provide negative feedback control at the DC output of preconditioner circuit 20. An external capacitor is connected to the DC pin to remove switching frequency noise.

An external lamp current transformer and load resistor are used to convert a lamp current signal into a voltage which is applied to a pair of lamp current input pins LI and LI2. The full wave rectified output of the lamp current is provided at a CRECT pin. A differential error amplifier within control circuit CC compares the voltage of the CRECT pin to an internal reference voltage based on the voltage at the VREG pin and adjusts the switching frequency of the DC-AC converter circuit 24 to maintain the current within a predetermined range (i.e. to maintain a substantially constant average lamp current). Control circuit CC is grounded through a GND pin.

Control circuit CC is similar in construction and operation to a control circuit 36 of U.S. Pat. No. 4,952,849. A more detailed description of the construction and operation of control circuit CC, except as noted herein, can be found by reference to control circuit 36 of U.S. Pat. No. 4,952,849. The construction and operation of control circuit 36 as disclosed in U.S. Pat. No. 4,952,849 is incorporated herein by reference thereto.

Figure 2:
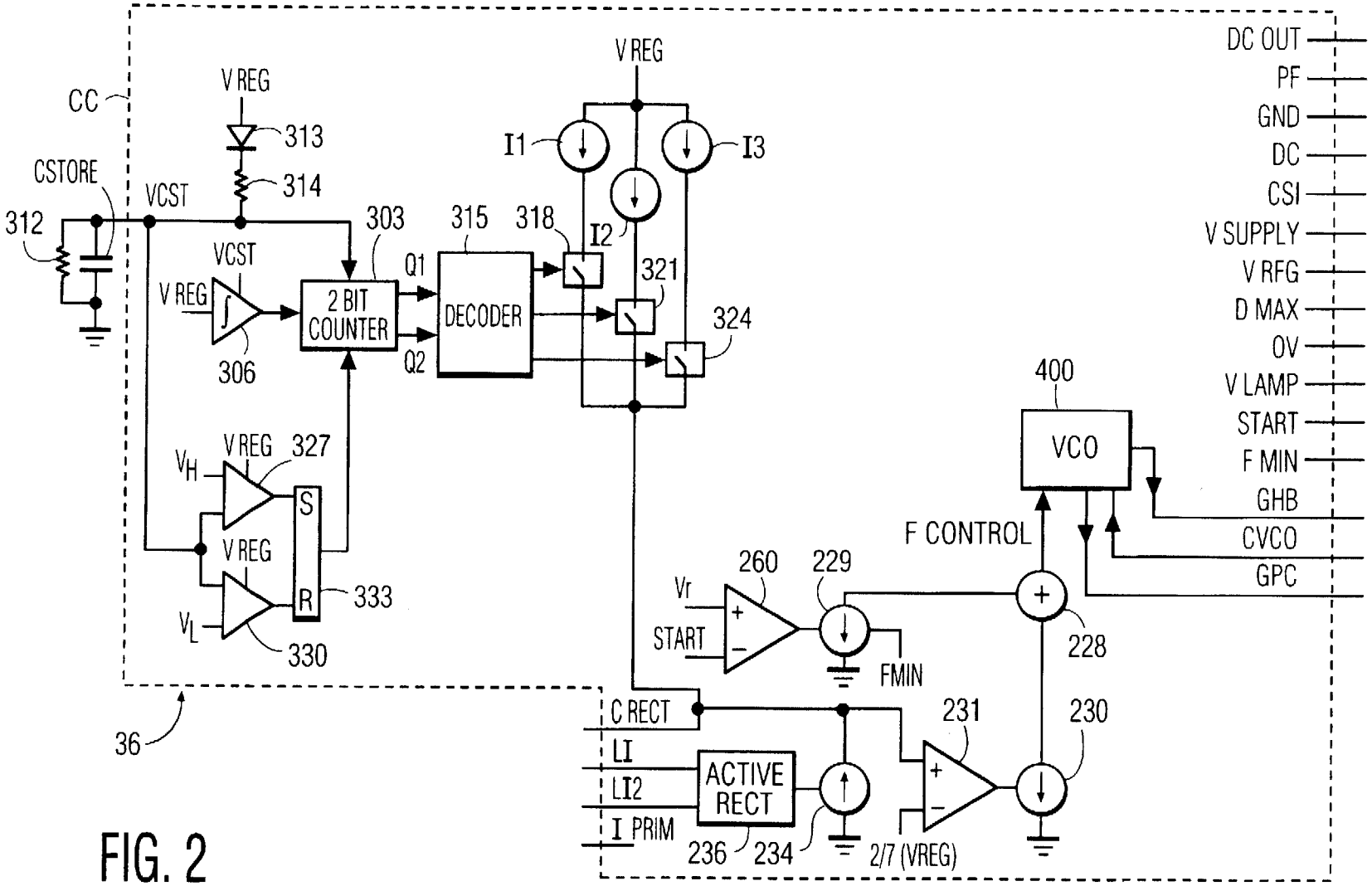
FIG. 2 is a partial schematic and partial logic diagram illustrating a control circuit of FIG. 1 for adjusting the level of illumination produced by a lamp load.

Reference should now be had to FIG. 2 which illustrates the circuitry within control circuit CC for controlling the level of illumination based on toggling of switch SW (i.e. interrupting the supply of power from mains power supply MPS to ballast B). The lamp load, which can be one or more fluorescent lamps 11 and 12, when first turned on, is operating at an initial, prefixed level of illumination. This prefixed level is typically at full illumination. It is to be understood that in accordance with this invention, the prefixed level can be at less than full illumination. Upon initial energization of ballast B and during operation thereof, an operating voltage is supplied to control circuit CC through the VSUPPLY pin. Control circuit CC develops a regulated voltage at the VREG pin based on the operating voltage supplied to the VSUPPLY pin.

The change from the prefixed level of illumination is communicated to ballast B by turning switch SW off and on (i.e. toggling) one or more times within a predetermined period of time. Prior to turning switch SW off the first time, that is, when the lamp load is operating at full illumination, a 2 bit counter 303 is at a 0 count (i.e. Q0=0, Q1=0). Counter 303 is a positive edge triggered, two bit ripple counter with an active high reset.

When switch SW is turned off, the voltage at the VSUPPLY pin will decrease. A ramping decrease in the voltage at the VREG pin results. When the voltage at the VREG pin decreases to a preset level (i.e. Vtrip), a Schmitt trigger 306 generates a pulse which is provided as the clock input to counter 303. The voltage at the VCST pin is supplied to Schmitt trigger 306 to power the latter. The clock pulse generated by Schmitt trigger 306 increments by one the count of counter 303. When switch SW is open, that is, when the connection (coupling) between mains power supply MPS and ballast B is interrupted, capacitor CSTORE temporarily powers counter 303. Capacitor CSTORE is discharged through a resistor 312. A diode 313 prevents capacitor CSTORE from discharging through a resistor 314. The RC time constant of resistor 312 and capacitor CSTORE is relatively long as compared to the period of time that switch SW is generally turned off such that the voltage across capacitor CSTORE during this period of time is substantially constant. When switch SW is now turned back on, counter 303 has a value of 1 (i.e. Q0=1, Q1=0). A decoder 315 in response to the count value of 1 produces a switching signal so as to turn on a normally open switch 318. Current from a current source I1 is now supplied to the CRECT pin.

The injection of current from current source I1 into the CRECT pin will set the lamp load to 50% of its nominally rated, full level of illumination. By toggling switch SW once within the predetermined period of time and assuming an initial, prefixed level of illumination of 100% (i.e. full illumination), the illumination level of the lamp load will be dimmed to 50% of full output.

The feedback scheme resulting in this reduction in illumination is as follows: The additional current flowing into the CRECT pin provided by current source I1 temporarily raises the voltage level at the CRECT pin. The voltage at the noninverting input of a lamp current error amplifier 231 is raised. The output of lamp current error amplifier amplifier 231 controls a current source 230. As the voltage at the noninverting input of lamp current error amplifier 231 is raised, the current level of current source 230 increases. The outputs of current source 230 and a current source 229 are added together by a summing circuit 228. The output of summing circuit 228 serves as the FCONTROL signal for the pulse width modulator and oscillator circuitry within control circuit CC, that is, as the control signal to control the frequency of operation of a voltage control oscillator (VCO) 400. VCO 400 controls generation of the square wave gating signal produced at the GHB pin, that is, of the switching frequency for DC-AC converter circuit 24. Operation of VCO 400 is described in greater detail in connection with FIG. 8 of U.S. Pat. No. 4,952,849 which is incorporated herein by reference thereto.

As the current from current source 230 increases, the current from summing circuit 228, that is, the FCONTROL signal increases. This increase in the FCONTROL signal increases the VCO frequency, that is, the frequency in the square wave gating signal at the GHB pin. To establish a minimum frequency of operation for the voltage control oscillator, a control current is applied to current source 229 through a FMIN line as disclosed in U.S. Pat. No. 4,952,849. Current source 229 is also controlled by a frequency sweep amplifier 260. Frequency sweep amplifier 260 has a noninverting input connected to a reference voltage source Vr (proportional to the regulated voltage at the VREG pin) and an inverting input connected to the START pin as more fully disclosed in U.S. Pat. No. 4,952,849. Current source 229 outputs the greater of FMIN or the current supplied from frequency sweep amplifier 260.

As the switching frequency of DC-AC converter circuit 24 increases, the current of the lamp load decreases. This decrease in lamp load current results in a corresponding decrease in the difference between currents inputted to an active rectifier 236 through pins LI and LI2. This decrease in the difference between currents flowing into pins LI and LI2 results in a decrease in the current of a current source 234. The decrease in current of current source 234 lowers the voltage at the CRECT pin until the voltage at the noninverting pin becomes equal to the voltage at the inverting input of lamp current error amplifier 231. No further adjustments to the switching frequency are required. As compared to the voltage at the CRECT pin when the lamp load is at full illumination, the voltage at the CRECT pin remains essentially the same because of the high gain of lamp current error amplifier 231.

Two additional levels of illumination can be had based on the value of counter 303. When switch SW temporarily interrupts the supply of power from mains power supply MPS twice within a predetermined period of time, the value of counter 303 will have a count of 2. Decoder 315 in response a count value of 2 (i.e. Q0=0, Q1=1), will turn on a normally open switch 321. Current from a current source 12 is now supplied to the CRECT pin. By injecting current from current source I2 into the CRECT pin, the lamp load will be set to 25% of its nominally rated, full level of illumination through an associated increase in switching frequency of DC-AC converter circuit 24. Accordingly, by toggling switch SW twice within the predetermined period of time and assuming an initial, prefixed level of illumination of 100% (i.e. full illumination), the illumination level of the lamp load will be set to 25% of its full output. When switch SW interrupts the supply of power from mains power supply MPS thrice within a predetermined period of time, the value of counter 303 will have a count of 3. Decoder 315 in response a count value of 3 (i.e. Q0=1, Q1=1), will turn on a normally open switch 324. Current from a current source I3 is now supplied to the CRECT pin. By injecting current from a current source I3 into the CRECT pin, the lamp load will be set to 8% of its nominally rated, full level of illumination through an associated increase in switching frequency of DC-AC converter circuit 24. Accordingly, by toggling switch SW thrice within the predetermined period of time and assuming an initial, prefixed level of illumination of 100% (i.e. full illumination), the illumination level of the lamp load will be dimmed to 8% of full output. By toggling switch SW four times within the predetermined period of time, the illumination level of the lamp load will assume its initial, prefixed level of illumination since counter 303 now will have a count value of 0.

The current produced by current source I3 is greater than the current produced by current source 12 which is greater than the current produced by current source I1. In other words, the greater the level of current injected into the CRECT pin, the higher the temporary voltage at the noninverting input of lamp current error amplifier 230. More current is generated by current source 230 which results in a larger increase in the switching frequency of the DC-AC converter circuit 24. The larger the increase in switching frequency, the greater the decrease in lamp current and associated light output.

In accordance with the invention, other levels of dimming are possible and are not limited to 50%, 25% and 8%. Other levels of illumination can be provided by injecting into the CRECT pin for each level desired a current corresponding to that level of illumination. More or less levels of dimming also can be provided. For each level of dimming desired, a different level of current from a current source is fed into the CRECT pin. It is also to be understood that in accordance with the invention, the initial, prefixed level of illumination need not be at the nominally rated, full output. For example, the initial level of illumination can be at less than full output. The order in which the level of illumination changes also need not sequentially decrease until being reset to the initial, prefixed level of illumination. From the initial, prefixed level of illumination, for each toggle of switch SW, the level of illumination can sequentially increase, decrease or vary as desired.

The predetermined period of time during which switch SW must be toggled at least once is based on the RC time constant of resistor 312 and capacitor CSTORE. The predetermined period of time is equal to the interval of time during which capacitor CSTORE powers counter 303 with switch SW turned off.

When the period of time that switch SW is turned off is greater than the RC time constant of resistor 312 and capacitor CSTORE (i.e. beyond the predetermined period of time in which to toggle switch SW at least once), the voltage across capacitor CSTORE decays so as to no longer power counter 303. When the supply of power is once again supplied to ballast B by closing switch SW, the voltage at the VREG pin assumes a high logic level. The voltage at the VREG pin assumes a high logic level well before the voltage across capacitor CSTORE rises (i.e. at the VCST pin) due to the RC time constant of resistor 314 and capacitor CSTORE. When the voltage at the VREG pin is at a high logic level and the voltage at the VCST pin is at a low logic level, counter 303 is reset. The reset circuitry includes two comparators 327 and 330 and a bistable device such as an S-R flip flop 333. Comparators 327 and 330 compare their reference voltages $V_H$ and $V_L$ to the voltage at the VCST pin. Reference voltages $V_H$ and $V_L$ are different fractions of the voltage at the VREG pin. When the voltages at the VREG and VCST pins are at high and low logic levels, respectively, SR flip-flop 333 generates a pulse which resets the counter 303 to a value of 0. When counter 303 is at a count value of 0, switches 318, 321 and 324 are open. There is no additional current being fed into the CRECT pin from current source I1, I2 or I3 so as to reduce/dim the light output of the lamp load. The lamp load, that is, lamps 11 and 12 are at their nominally rated full light output. Once the voltage at the VCST pin rises to its high logic level, the pulse generated by S-R flip-flop 333 ends. The width of this pulse is controlled by reference voltages VH, VL and the rise time of the voltage at the VCST pin.

Any power line transient dips will not advance counter 303 since the voltage at the VREG pin is very well filtered by input rectifier circuit 32 and does not fall to zero during these dips. Typically when ballast B is turned on, the voltage at the VREG pin rises up to about 7.4 volts in about 40 to 50 milliseconds. When ballast B is turned off, the voltage at the VREG pin drops to 0 volts in about 500 milliseconds and the voltage at the VCST pin drops from about 6.7 volts to about 0 volts in about 5 seconds. In other words, the predetermined period of time is typically about 5 seconds. During this predetermined period of time, the voltage across capacitor CSTORE discharges from about 6.7 volts to about 0 volts.

As now can be readily appreciated, dimming is accomplished by injecting additional current supplied by current source I1, I2 or I3 into the CRECT pin causing the voltage at the CRECT pin to temporarily rise. The rise in voltage at the CRECT pin increases the current into VCO 400 sweeping the switching frequency of the half bridge inverter high. The lamp current is reduced until the voltage at the CRECT pin drops such that the voltage at the noninverting input is the same as the voltage at the inverting input of lamp current error amplifier 231.

Figure 3:
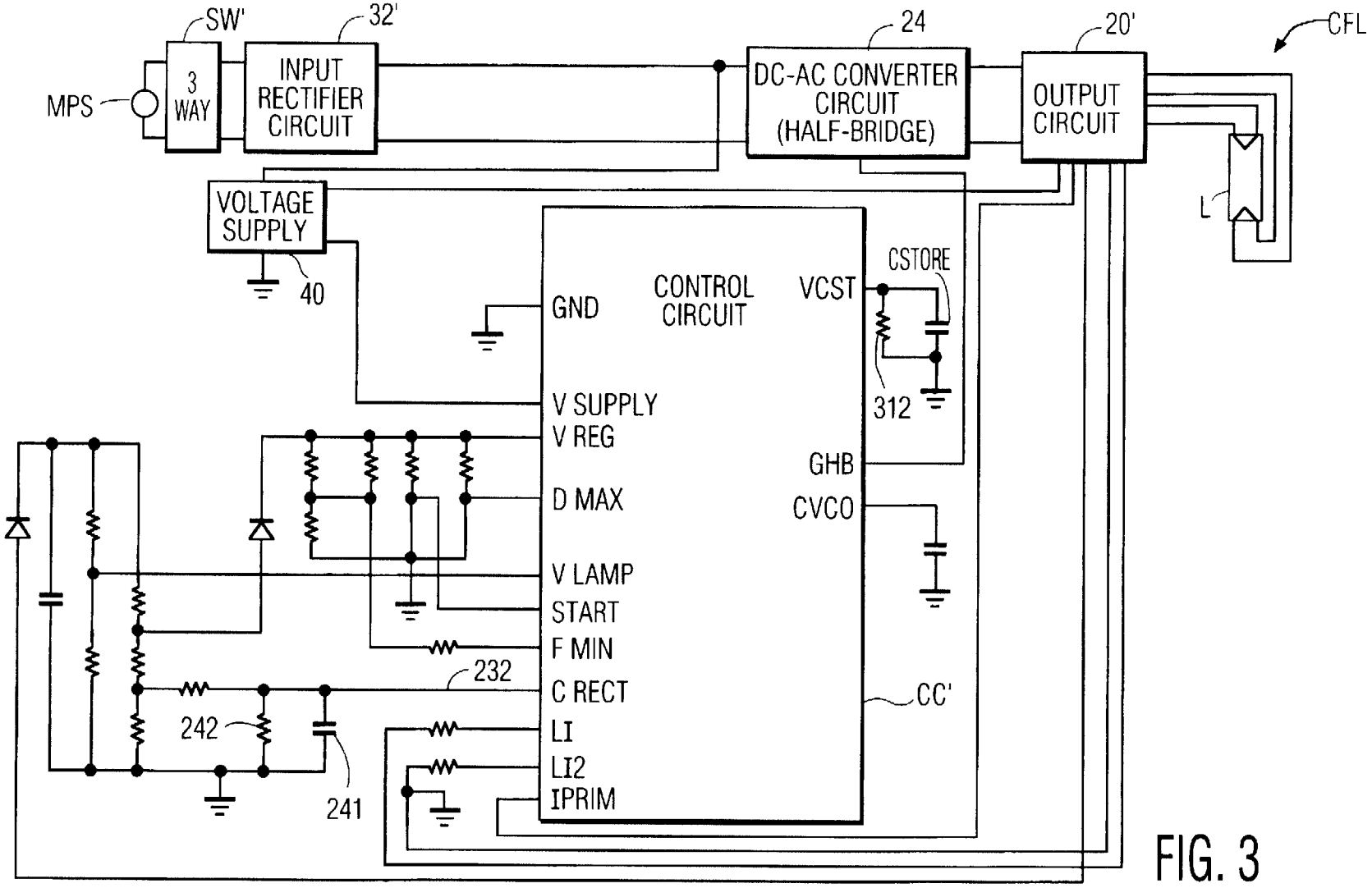
FIG. 3 is a partial block and partial schematic diagram illustrating a ballast in accordance with a second embodiment of the invention.

In accordance with an alternative embodiment of the invention, step dimming of a compact fluorescent lamp is provided by employing a three way switch. As shown in FIG. 3, a compact fluorescent lamp CFL is similar in construction and operation to the combination of ballast B and the lamp load of lamps 11 and 12 of FIG. 2. Those components of lamp CFL and ballast B which are identical have been identified with the same reference alphanumeric indicia.

Figure 4:
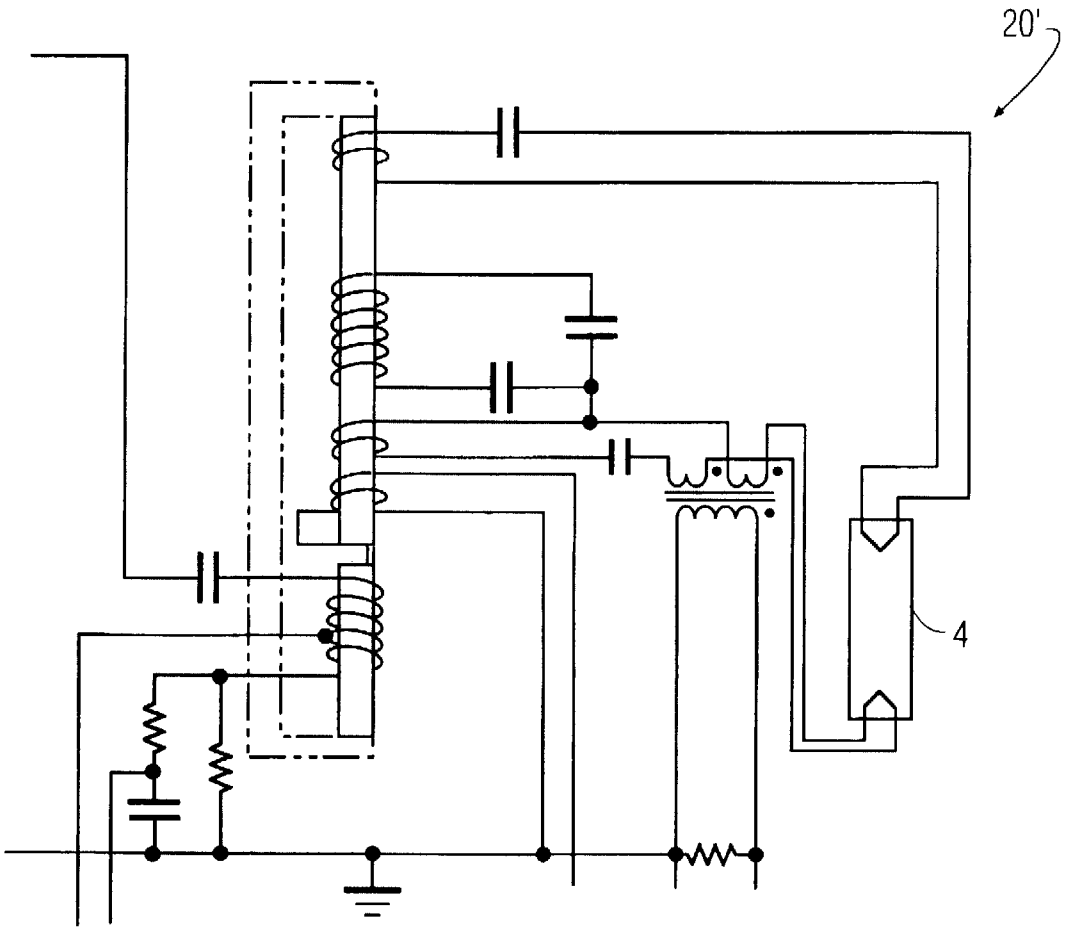
FIG. 4 is a schematic diagram of an input rectifier circuit of FIG. 3.

As shown in FIG. 4, an input rectifier 32' of lamp CFL is the same as input rectifier 32 of ballast B except that a voltage doubler VD of input rectifier 32' is substituted for the full bridge rectifier of input rectifier 32. Input rectifier 32' produces a full-wave rectified 50 or 60 hertz (Hz) voltage having a peak value of about 240 volts which is applied directly to the DC-AC converter circuit 24. A more detailed description of input rectifier 32' can be had by reference to the disclosure of input rectifier 32 in connection with FIG. 6 of U.S. Pat. No. 4,952,849 which is incorporated herein. Compact fluorescent lamp CFL includes no preconditioner circuit as compared to ballast B.

Figure 5:
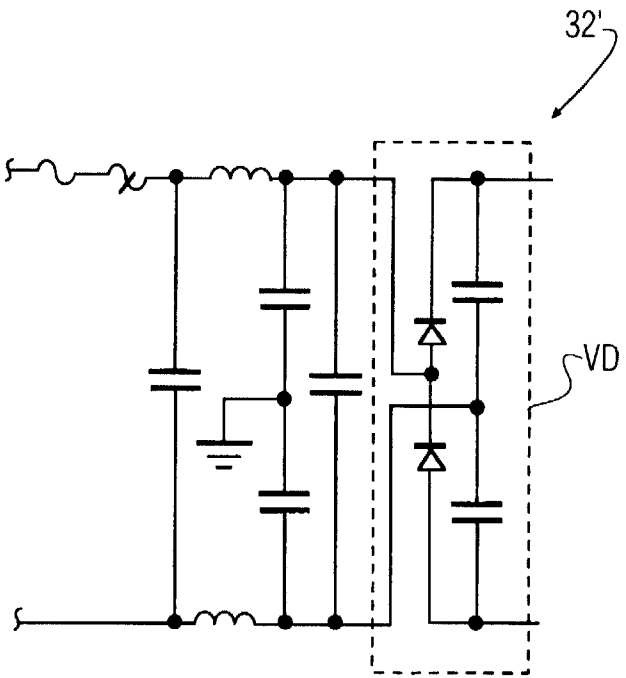
FIG. 5 is a schematic diagram of an output circuit of FIG. 4.

As shown in FIG. 5, output circuit 20' of compact fluorescent lamp CFL is connected to only one lamp L as compared to the connection of lamps 12 and 13 to output circuit 20 of ballast B. With only one lamp rather than two lamps connected to output circuit 20', components required for conditioning and starting of two lamps within output circuit 20 are not included within output circuit 20'. A detailed description of output circuit 20' can be had by reference to the disclosure of output circuit 20 in connection with FIG. 2 of U.S. Pat. No. 4,952,849 which is incorporated herein.

Referring once again to FIG. 3, control circuit CC' is the same as control circuit CC except that connections between control circuit CC and preconditioner 28 of ballast B are no longer required by control circuit CC'. There is no need for such connections inasmuch as compact fluorescent lamp CFL has no preconditioner.

As shown in FIGS. 3 and 6, switch SW' is a standard three way switch. Switch SW' includes a socket having three nodes A, B and C. Compact fluorescent lamp CFL generally includes a standard or small-bore fluorescent tube, bent or folded into a compact form with the electronic ballast portion (e.g. input rectifier 32', DC-AC converter circuit 24, output circuit 20', voltage supply 40 and control circuit CC') housed within an Edison type base. This base typically screws into the socket of switch SW' such that input rectifier 32' is coupled to nodes A and B.

Figure 6A:
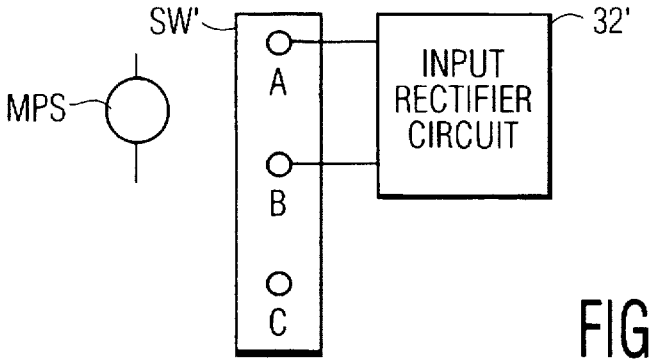
FIGS. 6A, 6B, 6C and 6D are block diagrams of the switching connections between a mains power supply and the input rectifier provided by a three way switch of FIG. 3.
Figure 6B:
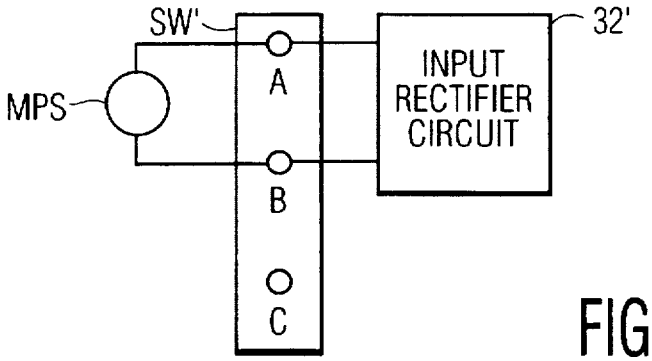
Figure 6C:
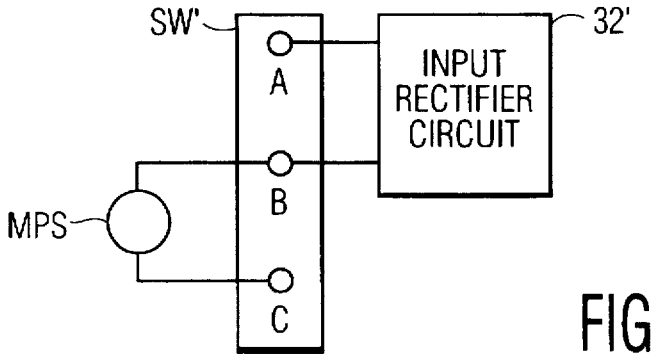
Figure 6D:
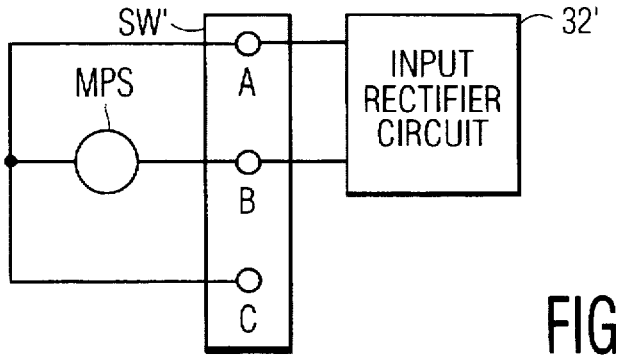

Switch SW' has four switch positions. FIG. 6A illustrates switch SW' in its first position (i.e. off position) whereby mains power supply MPS is not coupled to input rectifier circuit 32'. FIG. 6B illustrates switch SW' in its second position whereby mains power supply MPS is coupled to input rectifier circuit 32'. FIG. 6C illustrates switch SW' in its third position whereby mains power supply MPS is not coupled to input rectifier circuit 32'. FIG. 6D illustrates switch SW' in its fourth position whereby mains power supply MPS is coupled to input rectifier circuit 32'.

When first turning on compact fluorescent lamp CFL, switch SW' is switched from its first position to its second position. When a change in the level of light is desired, switch SW' can be toggled once by switching SW' from its second position to its third position and then fourth position within the predetermined period of time of, for example, 5 seconds. In other words, mains power supply MPS is switchably coupled to input rectifier circuit 32' through switch SW'. When in its first position (FIG. 6A) and third position (FIG. 6C), the coupling between mains power supply MPS and input rectifier circuit 32' is interrupted. Control circuit CC' senses each interruption and generates a gating (driving) signal at the GHB pin having a frequency based on the number of sensed interruptions in coupling between mains power source MPS and input rectifier 32'.

As now can be readily appreciated, ballast B and compact fluorescent lamp CFL incorporate a light dimming scheme which is responsive to one or more interruptions in mains power supply MPS through toggling of a switch SW and SW', respectively, in controlling the level of illumination desired. The number of power line interruptions through toggling produced within a predetermined period of time identifies the level of illumination desired. In the event that interruption of power to the ballast exceeds the predetermined period of time, the lamp load will be reset to a prefixed level of illumination once power is restored.

It will thus be seen that the objects set forth above and those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense. For example, the number of pins associated with the control circuit need not be limited to 20 as in control circuit CC or 14 as in control circuit CC' and can include more or less pins provided the control circuit includes functions related to line interruption and lamp current.

It is also to be understood that the following claims are intended to cover all the generic and specific features of the invention herein described, and all statements of the scope of the invention which, as a matter of language, might be said to fall therebetween.

What is claimed is:

1. A ballast switchably coupled to a voltage source for powering a discharge lamp, comprising:

an inverter responsive to a driving signal having a varying frequency;

sense circuitry for sensing each interruption in the coupling between the ballast and voltage source; and an oscillator for generating the driving signal at a frequency which varies based on the number of sensed interruptions in the coupling between the ballast and voltage source.

2. The ballast of claim 1, further including a temporary voltage source to power the sense circuitry for a predetermined period of time beginning with the first interruption.

3. The ballast of claim 1, further including reset circuitry for changing the frequency of the driving signal generated by the oscillator to a prefixed level in response to an interruption extending beyond a predetermined period of time.

4. The ballast of claim 3, wherein the sense circuitry includes a counter to identify the number of sensed interruptions within the predetermined period of time.

5. The ballast of claim 4, wherein the reset circuitry includes comparators and a bistable device for resetting the counter following restoration of coupling between the ballast and voltage source.

6. The ballast of claim 4, further including a current source for each non-zero value of the counter, each current source producing a different level of current; wherein the oscillator changes the frequency of the driving signal based on the level of current produced by the current source corresponding to the non-zero value of the counter.

7. The ballast of claim 4, further including a temporary voltage source to power the sense circuitry for the predetermined period of time beginning with the first interruption.

8. The ballast of claim 2 wherein the switchable coupling thereof comprises a manual switch coupled between the voltage source and a rectifier circuit at the input of the ballast, and said temporary voltage source includes an RC circuit whose RC time constant determines said predetermined period of time, whereby said predetermine period of time is independent of the off time of the manual switch.

9. The ballast of claim 1 wherein the sense circuitry includes a counter to determine the number of sensed interruptions within the predetermined period of time, the ballast further comprising means controlled by the counter for adjusting the oscillator frequency in steps thereby to adjust the inverter frequency in steps, where each frequency step corresponds to a different step of illumination level of the discharge lamp.

10. The ballast of claim 2 wherein the switchable coupling thereof comprises a switch coupled between the voltage source and a rectifier circuit at the input of the ballast, and said temporary voltage source is coupled to a source of DC voltage and to the sense circuitry when said switch is in its closed position.

11. The ballast of claim 1 wherein said inverter comprises a DC/AC converter, and the ballast further comprises;

an input rectifier circuit switchably coupled to a source of AC supply voltage via said coupling, a DC voltage supply means having an input coupled to an output of the input rectifier circuit, an output circuit coupled between an output of the DC/AC converter and the discharge lamp, and wherein the oscillator frequency is adjusted in steps as a function of the number of sensed interruptions in the coupling between the ballast and the voltage source.

12. A compact fluorescent lamp including a ballast switchably coupled to a voltage source for powering the lamp, the ballast comprising:

an inverter responsive to a driving signal having a varying frequency;

sense circuitry for sensing each interruption in the coupling between the ballast and voltage source; and an oscillator for generating the driving signal at a frequency which varies based on the number of sensed interruptions in the coupling between the ballast and voltage source.

13. The compact fluorescent lamp of claim 12, in combination with a three way switch for coupling the ballast to the voltage source.

14. The compact fluorescent lamp of claim 13, further including a temporary voltage source to power the sense circuitry for a predetermined period of time beginning with the first interruption.

15. The compact fluorescent lamp of claim 13, further including reset circuitry for changing the frequency of the driving signal generated by the oscillator to a prefixed level in response to an interruption extending beyond a predetermined period of time.

16. The compact fluorescent lamp of claim 15, wherein the sense circuitry includes a counter to identify the number of interruptions within the predetermined period of time.

17. The compact fluorescent lamp of claim 16, wherein the reset circuitry includes comparators and a bistable device for resetting the counter following restoration of coupling between the ballast and voltage source.

18. The compact fluorescent lamp of claim 16, further including a current source for each non-zero value of the counter, each current source producing a different level of current; wherein the oscillator changes the frequency of the driving signal based on the level of current produced by the current source corresponding to the non-zero value of the counter.

19. The compact fluorescent lamp of claim 16, further including a temporary voltage source to power the sense circuitry for the predetermined period of time beginning with the first interruption.

20. A method for adjusting the level of illumination of a fluorescent lamp powered by a ballast switchably coupled to a voltage source, comprising the steps of:

interrupting the coupling between the ballast and voltage source at least once within a predetermined period of time;

sensing each interruption in the coupling between the ballast and voltage source; and applying a voltage to the fluorescent lamp at a frequency which varies in response to the number of sensed interruptions in coupling between the ballast and voltage source.

21. The method of claim 20, further including temporarily providing power to sense circuitry for sensing each interruption for a predetermined period of time beginning with the first interruption.

22. The method of claim 20, further including changing the frequency of the voltage to a prefixed level in response to an interruption extending beyond a predetermined period of time.

23. The method of claim 22, further including temporarily providing power to sense circuitry for sensing each interruption during the predetermined period of time beginning with the first interruption.

* * * * *